US005456649A

United States Patent [19]

Horkey

[11] Patent Number: 5,456,649

[45] Date of Patent: Oct. 10, 1995

[54] WALL MOUNTED, ADJUSTABLE HANGING BAR FOR BACK STRETCHING

[76] Inventor: Gregory R. Horkey, P.O. Box 1452, Monterey, Calif. 93942

[21] Appl. No.: 95,205

[22] Filed: Jul. 23, 1993

[51] Int. Cl.[6] ..... A63B 1/00

[52] U.S. Cl. ..... 482/39; 482/96; 482/904; 482/907

[58] Field of Search ..... 482/38, 39, 40, 482/139, 143, 904, 907, 908, 75, 91, 101, 114, 96; 606/241; 602/32, 36

[56] References Cited

U.S. PATENT DOCUMENTS

| | | | |
|---|---|---|---|
| 1,547,024 | 7/1925 | Byrne et al. | 482/75 |
| 2,057,013 | 10/1936 | Cartis | 482/75 |
| 3,353,532 | 11/1967 | Ellis . | |
| 3,430,953 | 3/1969 | Teetor | 482/40 |
| 4,317,566 | 3/1982 | Uyeda et al. | 482/139 |
| 4,372,552 | 2/1983 | Carlmark . | |
| 4,492,375 | 1/1985 | Connelly | 482/139 |
| 4,759,539 | 7/1988 | Nieppola | 482/908 |

FOREIGN PATENT DOCUMENTS

| | | | |
|---|---|---|---|
| 2462157 | 7/1979 | France | 482/904 |
| 0432637 | 9/1926 | Germany | 482/38 |

*Primary Examiner*—Richard J. Apley
*Assistant Examiner*—Jeanne M. Mollo

[57] ABSTRACT

A back stretching invention that consist of a vertical main tube (11) that is fitted with a rib (12) and is fixed to the wall via plate (15). Located on the main tube (11) is a slider (17) that moves vertically on said tube to raise and lower handle tube (22). The handle tube (22) is were the uses grasps with their hands and hangs, stretching their spine, strengthening their muscles.

8 Claims, 4 Drawing Sheets

WALL MOUNTED, ADJUSTABLE HANGING BAR FOR BACK STRETCHING

BACKGROUND—FIELD OF INVENTION

This invention relates to a back stretching device, specifically a wall mounted, adjustable stretcher that is used as a preventative measure against back strain and muscle injuries.

BACKGROUND—DESCRIPTION OF PRIOR ART

Offices and large companies typically have many employees with sitting or standing jobs, extending for long periods of time that build up pressure on the spine and puts strain on back muscles from incorrect posture. This constant pressure leads to back injuries involving torn muscles, disc fluid leakage, and mental fatigue.

In the past, back stretching was used after the damage was done as a corrective procedure. A few back stretchers were invented to correct the spine and musculature injuries. U.S. Pat. No. 4,372,552 to Carlmark (1983) discloses a hanging device that comprises a vertically adjustable stand that requires complex adjustment and fitting to the body.

The user alone could not fix it about their body. By virtue of its construction it also is very hard to adjust to the desired height evenly.

Another U.S. Pat. No. 3,896,798 to Peter J. Simon (1973) is simple to use but takes up a large amount of floor space. With floor space so expensive in offices, the footprint of the back stretcher needs to be as small as possible while still being stable.

U.S. Pat. No. 3,353,532 to Ellis (1967) describes a back stretcher that suspends the user off the ground with springs and levers that are very complex in construction and costly to manufacture. The price needs to be as inexpensive as possible to make it accessible to people.

To create a back stretcher that was easy to use and which spanned a large range of body sizes, U.S. Pat. No. 4,113,250 (Davis (1976) had a motor to invert the user. To use that back stretcher required electricity which isn't always available. Another obvious drawback is that women in dresses could not use that back stretcher.

All the above stated back stretchers have an older archaic styling, and would not be considered modern in today's product climate.

OBJECTS AND ADVANTAGES

Although the back stretching concept is not new, this invention embraces several objects and advantages which axe:

(a) to provide a back stretcher that is simple to adjust and easy to use so one person is able to operate it alone.

(b) to provide a back stretcher that has a small "footprint" (little or no floor space), yet is still stable enough for people to hang on.

(c) to provide a back stretcher that is simple to manufacture so the cost factor is small, allowing the invention to be affordable for most people.

(d) to provide a back stretcher that is independent of machines and complex mechanisms that are heavy, costly, and break down.

(e) to provide a back stretcher that is usable by both sexes and all ages. It can accommodate people wearing all types of clothing and jewelry.

(f) to provide a back stretcher that looks contemporary, fitting with current design trends.

Further objects and advantages are to provide a back stretcher that displays the company's name in a prominent way, which uses as little material as possible so it is easier on the environments resources, and is comfortable to use. Still further objects and advantages will be evident from the following descriptions and the accompanying drawings.

DRAWING FIGURES

The invention is described by referencing the accompanying drawings.

Figure 1:
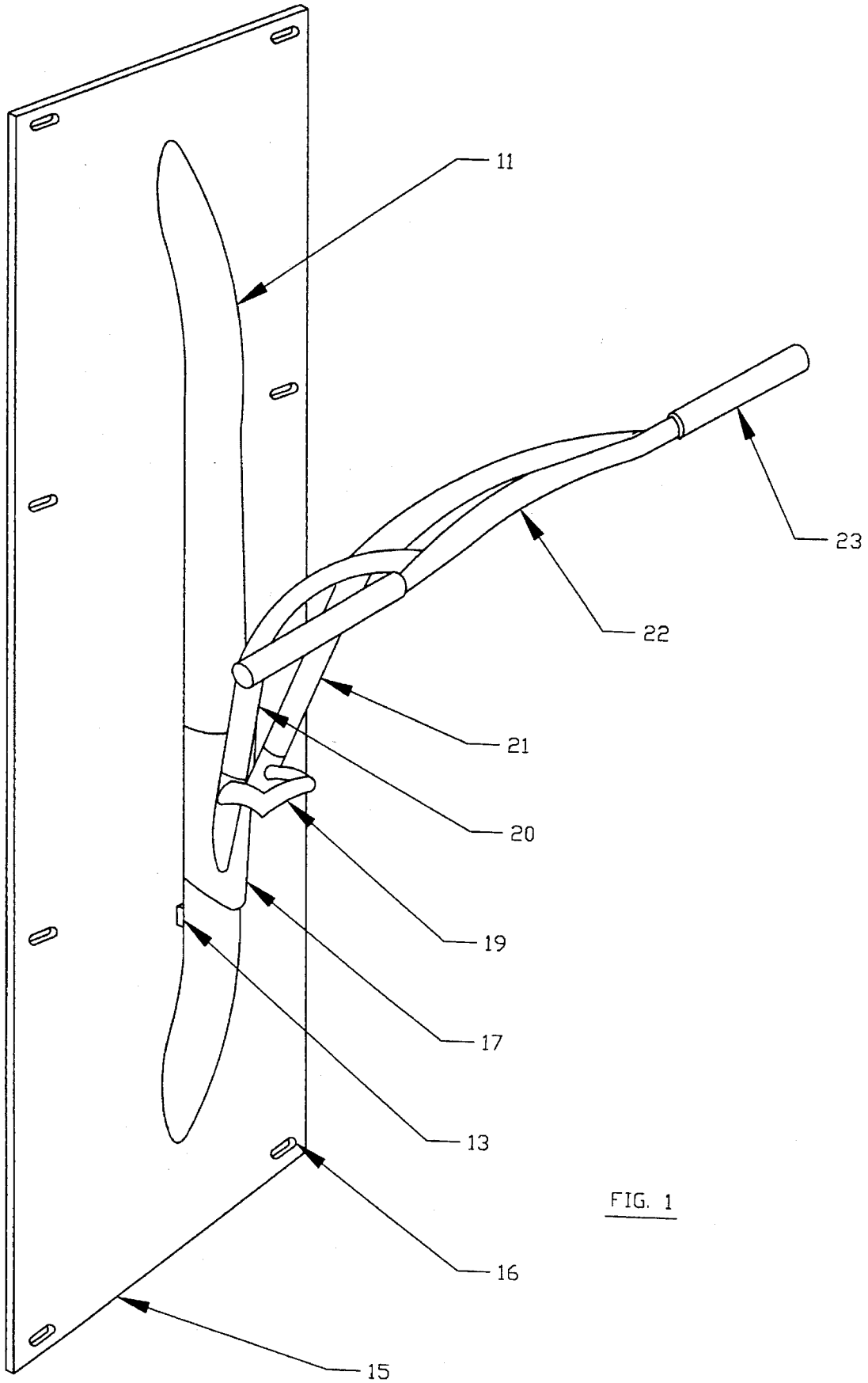
FIG. 1 is a perspective view of the entire hang devise in middle range of adjustment.

FIG. 30~A is a side view of the first two steps of the height adjustment process.

FIG. 30~B is a side view of the last two steps of the height adjustment process.

REFERENCE NUMERALS IN DRAWINGS

The invention consists of many manufactured parts. In the drawings these numbers correspond with the parts:

11—main tube
12—rear rib
13—lower limiter
14—main tube caps
15—mounting plate
16—lag bolts (8)
17—slider body
18—locking pin
19—handle
20—upright tube
21—upright tube
22—handle tube
23—grips The drawings also illustrate possitions and movements as indicated by these letters:

C—starting position (at rest)
D—disengaged position
E—Adjusted hight position
F—finnished position (at rest)
G—disengageing movement
H—verticle adjustment movement
I—locking movement

DESCRIPTION—FIGS. 1, 2, 3~A, 3~B

A typical embodiment of this back stretcher is illustrated in FIG. 1 (perspective view). The main tube 11 with rear rib 12 and lower limiter 13 are pop riveted together along the longitudinal distance with main tube caps 14 welded on the inside of main tube 11. The preferred embodiment is a roll formed steel tube with mandrel bent ends. However the main tube 11, rib 12, limiter 13, and caps 14 could all be made out of any material that is dimensionally stable and able to hold up to high tension loads, such as other metals, resin/fibers, and ABS plastics.

Main tube 11 is orientated vertically on plate 15 and is riveted from the back through caps 14 to join main tube 11 permanently with plate 15. Plate 15 is fastened to the wall, between studs, with lag bolts 16. The preferred embodiment of plate 15 is pressed fiber board, but any material that resists tearing, flexing, and is lightweight can be used, like sheet steel, aluminum, or fiber glass.

Slider body 17 positioned in the middle of tube 1 contains handle 19 and tubes 20 and 21 that arch away from the wall at a 45° angle. The preferred embodiment of slider 17 is cast aluminum and tubes 20 and 21 mandrel bent steel. However the slider 17 can be of any material that can be cast, like two part epoxy and metal, or that canbe welded. As displayed in FIG. 3, locking pin 20 is part of slider 17 and is made of the same material. Handle 19 is to be of plastic but can be made of any material that can be cast. The joints between slider 17, tubes 20, and 21 should be bonded with a two part epoxy, fitted with a set screw or a weld.

Handle tube 22 is held parallel to the wall by tubes 20 and 21. The preferred embodiment of tube 22 is steel tube but is not limited to steel, it could be made of any light, torsionally strong material such as fiber glass, plastic, or other metals.

Both ends of tube 22 are fitted with grips 23. The preferred embodiment of grips 23 is neoprene. However the material can be any soft, grip-like material such as cork tape, closed cell foam or open cell foam.

Figure 2:
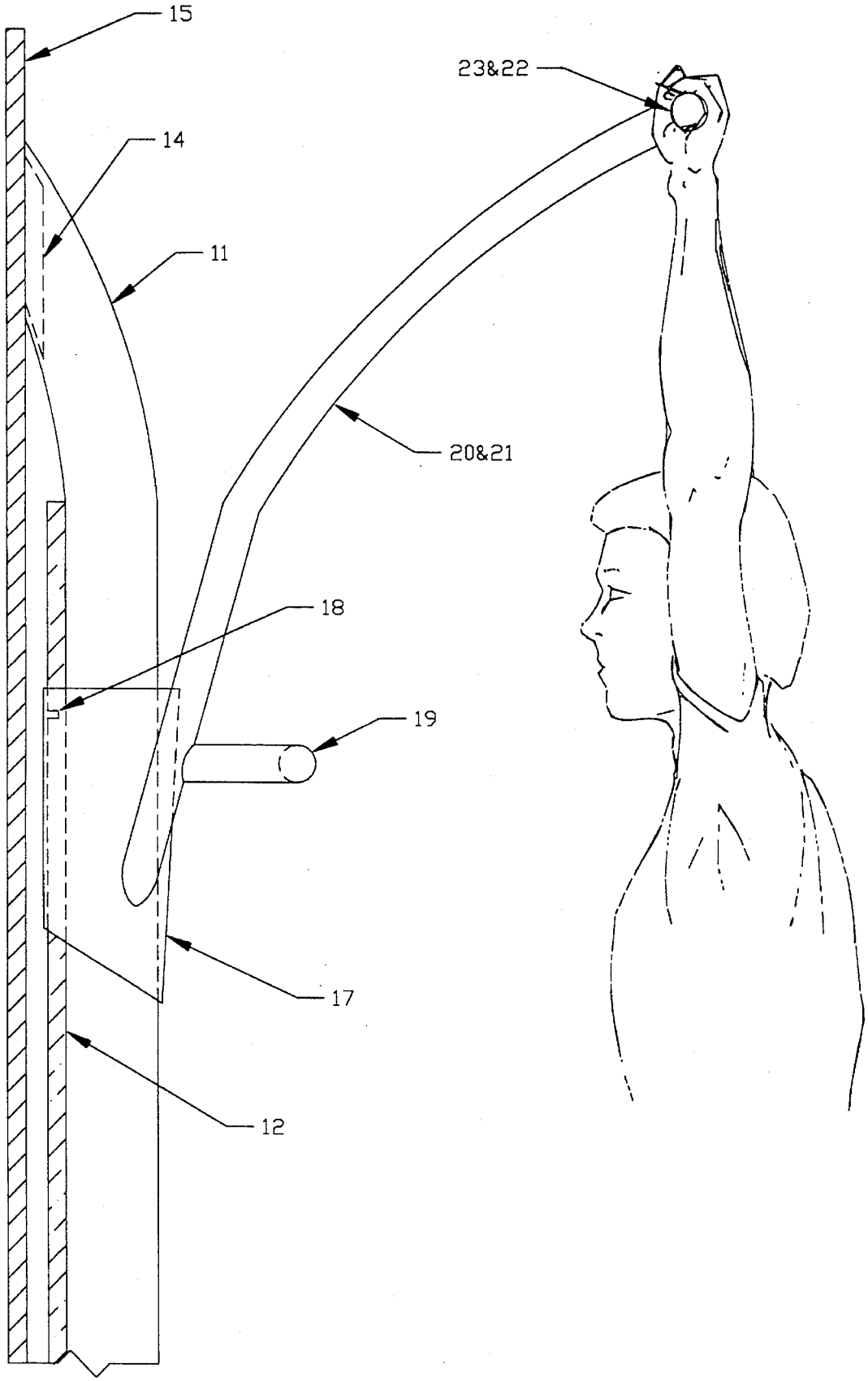
FIG. 2 is a side view of FIG. 1 with a person hanging, as intended, from the bar.

As shown in FIG. 2 the unit containing 17–23 is limited in the vertical direction by limiter 13 located at the bottom back side above the bend in tube 1 and at the top by another bend in tube 1.

There are various possibilities with regard to dimensions and proportions. Each part can be manipulated to embody a longer size or stronger form.

OPERATION—FIGS. 2, 3

Figure 3A:
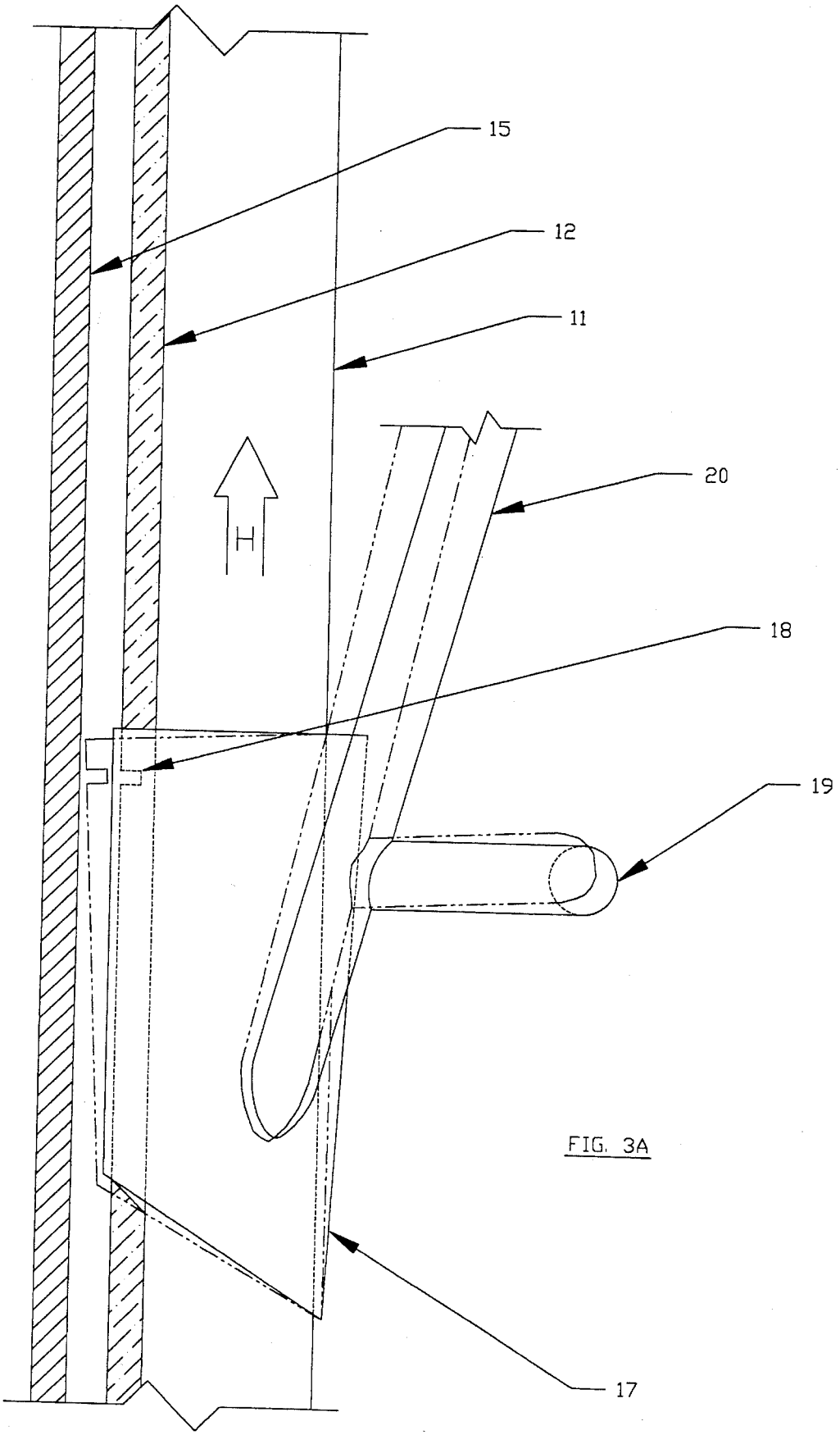
Figure 3B:
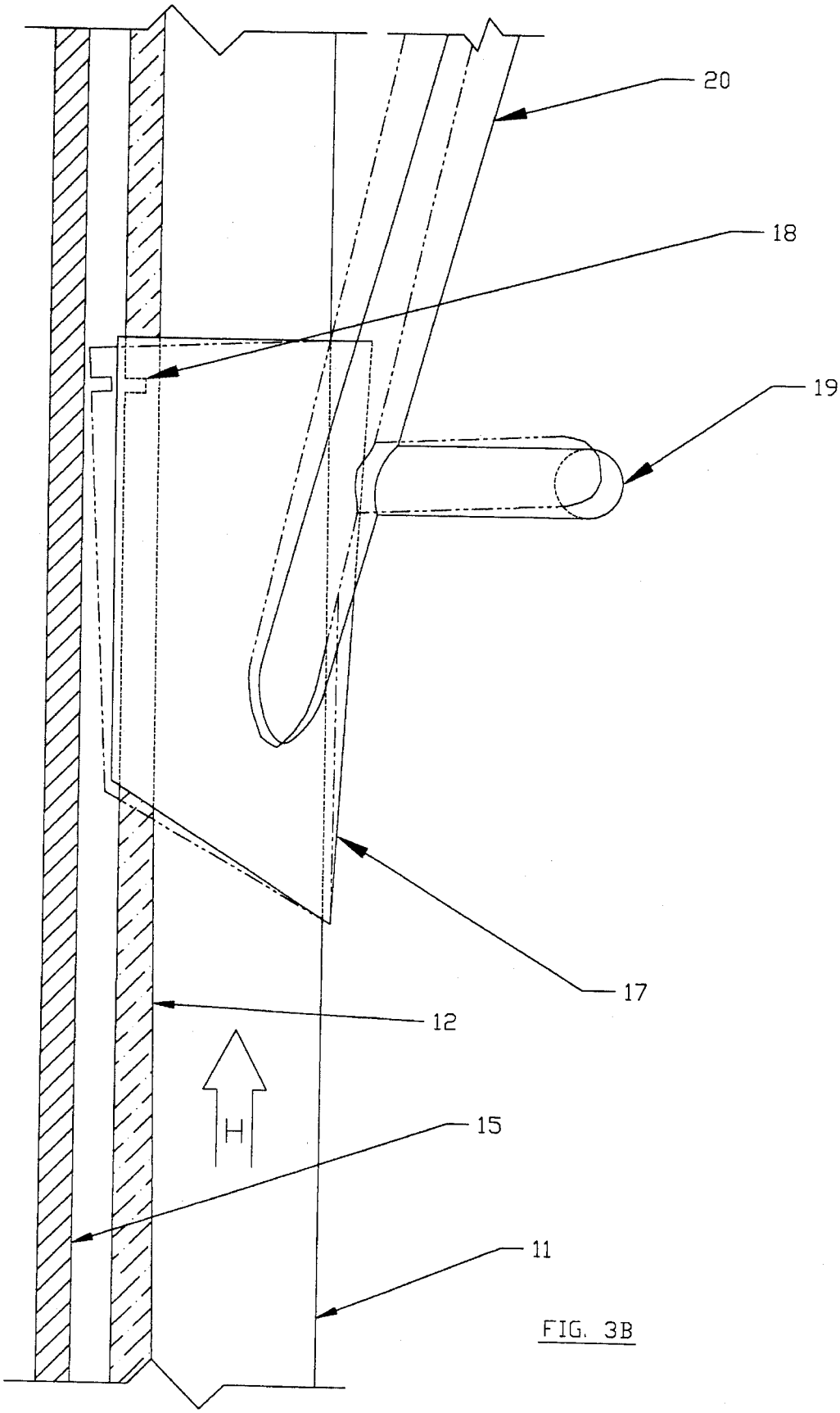

The manner of operating the invention in order to stretch the back first requires adjustment of unit 17–23 to the desired height. The best height is achieved when handle 19 is at eye level with the user, or tube 22 is at the end of outstretched finger when the users feet are fiat on the ground. The user must adjust the height of tube 22 by first grasping handle 19 with a hand and pushing towards the wall (movement G), from position C to position D, as shown in FIG. 3~A. Secondly, slide unit 17–23 vertically (movement H), from position D to position E, along main tube 11 with handle 19. Thirdly the user lets slider 17 rotate down toward them until locking pin 6 engages in a hole in rear rib 2,(movement I), from position E to Possition F as shown in FIG. 3~B.

The user then reaches up on tip toes, or other means, and grasps grips 23 on tube 22. The user then relaxes all their muscles while continuing hanging for six to ten seconds as shown in FIG. 2. If increased separation between the vertebra or stretching of the muscles are desired, the user can swing their legs or raise their knees towards their chest slightly. If muscle development and strengthening is desired the user can pull their body towards the tube and then release back down again.

When hanging is completed, the user releases their hands and lets go of the back stretcher. To have an a effect, the above process should be repeated every few hours, five days per week.

SUMMARY, RAMIFICATIONS, AND SCOPE.

Accordingly, the reader will observe this back stretcher will provide an easy to use and adjustable stretching devise. This back stretcher takes up very little floor space to operate. The cost to produce this back stretcher is inexpensive, allowing the end product be less expensive so that distribution is wider. In addition, this back stretcher is independent of motors and electric power, making this back stretcher free to use, with low maintenance. Further, this back stretcher is usable by both sexes, and all sizes of people with all clothing styles. Also, this back stretcher looks contemporary enough to be used in the office, home, or corporate environment.

Although the above description relates to many preferred embodiments, these are not constraining this back stretcher to mounting surfaces, particular dimensions, proportions, and materials. The materials can range from the hard, formable materials stated to others such as wood.

Thus the scope of this back stretcher should be determined by the appended claims and their legal equivalents, rather than by the examples supplied.

I claim:

1. A back stretcher essentially consisting of a plate with one face adapted to be fixed to a wall and an opposite face, a vertical tube mounted on the opposite face of said plate, a rib fixedly attached to said tube, a sliding fixture slidably mounted to said vertical tube and a means for locking the sliding fixture stationary with respect to the tube; wherein said sliding fixture includes support tubes rigidly connected to a sleeve at a first end, said sleeve having means for embracing said rib, a bar mounted to said support tubes at a second end, and a handle attached to the support tubes with means to adjust the height of the sliding fixture so that the user can allow himself to hang freely while gripping the bar with his hands.

2. The back stretcher of claim 1 wherein said plate is composed of metal.

3. The back stretcher of claim 1 wherein said vertical tube is composed of metal and has bent ends which constitute a safety feature whereby the bent ends would stop the sliding fixture from injuring the user if the sliding fixture should slip accidentally.

4. The back stretcher of claim 1 wherein said sliding fixture is composed of metal and slides freely on said vertical tube.

5. The back stretcher of claim 1 wherein said bar is located at the top of said sliding fixture.

6. The back stretcher of claim 1 wherein said support tubes are secured to said sliding fixture in a manner that the support tubes are oriented in an upward fashion.

7. The back stretcher of claim 1 wherein said bar is fixed to said support tubes and is made of metal.

8. The back stretcher of claim 1 wherein said rib embraced by said sliding fixture is made of metal and is located on a surface of said vertical tube that faces said plate.

* * * * *